US006999699B2

(12) United States Patent
Nagatomo et al.

(10) Patent No.: US 6,999,699 B2
(45) Date of Patent: Feb. 14, 2006

(54) CONTACT CHARGER AND IMAGE FORMING APPARATUS

(75) Inventors: Yuji Nagatomo, Amagasaki (JP); Makiko Tango, Kyoto (JP)

(73) Assignee: Konica Minolta Business Technologies Inc., Tokyo (JP)

( * ) Notice: Subject to any disclaimer, the term of this patent is extended or adjusted under 35 U.S.C. 154(b) by 108 days.

(21) Appl. No.: 10/745,858

(22) Filed: Dec. 29, 2003

(65) Prior Publication Data

US 2005/0069345 A1 Mar. 31, 2005

(30) Foreign Application Priority Data

Sep. 26, 2003 (JP) ..... 2003-334725

(51) Int. Cl.
*G03G 15/02* (2006.01)

(52) U.S. Cl. ..... 399/175; 361/221

(58) Field of Classification Search ..... 399/175, 399/174, 176, 168; 361/221, 225; 430/902

See application file for complete search history.

(56) References Cited

U.S. PATENT DOCUMENTS

| | | | | |
|---|---|---|---|---|
| 5,508,788 | A * | 4/1996 | Watanabe et al. | 399/175 |
| 6,081,681 | A | 6/2000 | Nagase et al. | 399/174 |
| 6,289,190 | B1 | 9/2001 | Amamiya et al. | 399/174 |
| 6,366,751 | B1 * | 4/2002 | Shakuto et al. | 399/175 X |
| 2001/0026695 | A1 * | 10/2001 | Uno | 399/175 X |
| 2002/0021917 | A1 * | 2/2002 | Ishiyama et al. | 399/175 |

FOREIGN PATENT DOCUMENTS

JP 10-307458 11/1998

* cited by examiner

*Primary Examiner*—Sophia S. Chen
(74) *Attorney, Agent, or Firm*—Morrison & Foerster LLP

(57) ABSTRACT

A contact charger for charging a charging target (e.g., a photosensitive member) includes a brush to be in contact with the charging target, and auxiliary charging particles to be interposed between the brush and the charging target. Fibers of the brush have a volume resistivity from $1\times10^{1}$ Ω·cm to $1\times10^{8}$ Ω·cm, a primary particle diameter of the auxiliary charging particles is in a range from 0.01 μm to 10 μm, and a push-in amount of the brush with respect to the charging target is in a range from 0.1 mm to 2.0 mm. The brush moves relatively to the charging target for charging the charging target. An image forming apparatus includes a photosensitive member to be charged by the charger.

18 Claims, 1 Drawing Sheet

CONTACT CHARGER AND IMAGE FORMING APPARATUS

CROSS-REFERENCE TO RELATED APPLICATION

This application is based on Japanese patent application No. 2003-334725 filed in Japan on Sep. 26, 2003, the entire content of which is hereby incorporated by reference.

BACKGROUND OF THE INVENTION

1. Field of the Invention

The present invention relates to a contact charger for use in an electrophotographic image forming apparatus such as a copying machine or a printer, and also relates to an image forming apparatus provided with such a contact charger.

2. Description of Related Art

<Corona Charger>

Conventional image forming apparatuses such as an electrophotographic device have employed corona chargers, which utilize corona discharging for charging a charging target (i.e., an object to be charged) such as a photosensitive member for electrophotography.

The corona charger is arranged in a noncontact manner with respect to the charging target, and is configured such that a high voltage is applied, e.g., to a wire electrode or a needle electrode for causing corona discharging, and thereby a part of discharge current thus caused flows through the charging target to place a predetermined potential on the charging target.

However, the corona charger utilizing the corona discharging generates a large amount of ozone, which causes a problem in environment due to ozone smell. Also, a large amount of ozone deteriorates the charging target, and/or a discharging product due to corona discharging (i.e., material produced by corona discharging) may adhere to a surface of the charging target. Thereby, quality of images is impaired, and/or the charging target has to be shaved for recovery from deterioration due to the adhered discharging product so that the life thereof is reduced. Further, a power source of a high voltage and therefore an expensive power source are required.

<Contact Charger (Charging by Discharging)>

In recent years, therefore, many contact chargers have been proposed for use instead of the corona chargers. For example, a roller charger, a fur-brush charger, a blade charger and others have been proposed. These chargers are configured to charge the charging target by utilizing a discharging phenomenon, which occurs between the charging target and the charging member. The charging member is arranged in direct contact with the charging target, and a voltage is applied to the charging member to place a predetermined potential on the charging target.

The roller charger includes, e.g., an elastic roller having an electrically conductive elastic layer. The elastic roller is in contact with the charging target to form a nip, and a voltage is applied to the elastic roller to charge the charging target. In many structures, the elastic roller is driven to rotate by the charging target.

The fur-brush charger is formed of, e.g., a fur-brush roller having electrically conductive brush fibers. The fur-brush roller is in contact with the charging target to form a nip, and a voltage is applied to the fur brush to charge the charging target. Since the fibers used therein are extremely thin, a strong electric field is locally produced between the fur brush and the charging target, and excessive discharging not following Paschen's law occurs in the strong electric field so that irregular charging occurs. Since the contact between the charging target and the brush fibers consists of a gathering or combination of line-contact and/or point-contact, it is difficult to ensure a sufficiently large contact area between the charging target and the fur brush so that it is impossible to prevent insufficient charging due to insufficient contact.

These contact chargers can charge the target with power sources of lower voltages than those of the corona charger. In these contact chargers, however, a voltage prepared by adding a threshold voltage for following Paschen's law to an intended charging potential must be applied to the charging member. Further, the amount of produced ozone can be smaller than that of the corona charger, but disadvantages due to the discharging product are unavoidable because the charging operation utilizes the discharging phenomenon.

<Contact Charger (Injection Charging)>

For overcoming the above problems, such a contact charger has been proposed that injects electric charges directly into a charging target without utilizing the discharging phenomenon. For example, a magnetic brush charger, a roller charger, a fur-brush charger and others have been proposed as the contact chargers utilizing injection charging.

These chargers are configured to charge the charging target to bear an potential substantially equal to the voltage applied to the charging member, and therefore can utilize a charging voltage lower than that of the foregoing contact charger utilizing the discharging phenomenon. Further, the discharging does not occur so that the discharging product is not generated, and disadvantages due to the discharging product do not occur.

The magnetic brush charger is formed of, e.g., a nonmagnetic sleeve covering a magnetic roller, and electrically conductive and magnetic particles retained on the sleeve. A spike (magnetic brush) formed of the conductive and magnetic particles is in contact with the charging target to form a nip, and a voltage is applied to the magnetic brush to charge the charging target by charge injection. This type of charger requires a complicated structure, and therefore is expensive. Further, it suffers from dropping of conductive and magnetic particles as well as image noises due to adhesion of the conductive and magnetic particles onto the charging target such as a photosensitive member.

The roller charger is formed of, e.g., a conductive and elastic roller. The conductive and elastic roller is brought into contact with the charging target to form a nip, and a voltage is applied to the elastic roller to effect injection charging on the charging target. For effecting the injection charging on the charging target, a sufficient contact area is required between the roller surface and the charging target. However, such a sufficient contact area cannot be achieved if the elastic roller is merely driven to rotate by the charging target. For obtaining the sufficient contact area, a difference may be provided between peripheral speeds of the elastic roller and the charging target so that the elastic roller may slide on the charging target.

However, since the elastic roller is in face-contact with the charging target, a large frictional force occurs. Thereby, the surfaces of the charging member and the charging target may be shaved to generate image noises, and the durability thereof may be reduced.

For reducing the frictional force, Japanese Laid-Open Patent Publication No. 10-307458 has disclosed a roller charger, in which conductive particles are disposed in a contact nip between the roller charger and the charging target. Even in this structure, a frictional force is larger than that in the chargers, which utilize line-contact and/or point-contact of a fur-brush or a magnetic brush, and therefore, the charging member and the charging target are shaved so that image noises occur, and low durability is unavoidable.

For example, U.S. Pat. Nos. 6,081,681 and 6,289,190 have disclosed fur-brush chargers, in which a fur brush carrying conductive particles is in contact with the charging target to form a nip, and a voltage is applied to the fur brush to perform injection charging on the charging target. Since the fur brush is in line-contact and/or a point-contact with the charging target, a frictional force between them is small, and wearing of the charging member and the charging target is considerably suppressed. Further, the discharging phenomenon is not utilized so that irregular charging due to excessive discharging can be prevented. Since the conductive particles are present between the charging target and the fur brush, insufficient contact between the fur brush and the charging target can be suppressed, as compared with the foregoing fur brush charging utilizing the discharging phenomenon.

However, according to the conventional fur brush injection charger described above, it is impossible to lower sufficiently a contact resistance (electric resistance) between the fur brush and the charging target so that uniform charging cannot be performed in some cases. In an example disclosed in foregoing U.S. Pat. No. 6,289,190, a fur brush of 14 mm in outer diameter is in contact with a photosensitive member of 30 mm in diameter, and a nip of 3 mm in width is formed for charging the photosensitive member.

However, this U.S. patent has not taught an appropriate range of the push-in amount of the fur brush with respect to the photosensitive member, which is important for reducing the contact resistance between the fur brush and the photosensitive member. The injection charging is primarily performed in the contact area between the charging member and the charging target. However, even if the contact area is sufficiently large, uniform charging without irregularity cannot be performed when the contact resistance is large. It is necessary to ensure an appropriate push-in amount in addition to an appropriate contact area.

SUMMARY OF THE INVENTION

An object of the invention is to provide a contact charger having a brush to be in contact with a charging target, and particularly to provide a contact charger, which can sufficiently lower a contact resistance (electric resistance) between the brush and the charging target, and can perform uniform charging without irregularity.

Another object of the invention is to provide a contact charger, which can perform stable charging for a long term with a low voltage and at a low cost without generating ozone.

Still another object of the invention is to provide an electrophotographic image forming apparatus using a contact charger for charging a photosensitive member, and particularly to provide an image forming apparatus, which can stably and uniformly charge the photosensitive member for a long term, and thereby can form good images for a long term while suppressing image noises.

According to the invention, a contact charger for charging a charging target includes a brush to be in contact with the charging target, and auxiliary charging particles to be interposed between the brush and the charging target.

Fibers of the brush have a volume resistivity from $1\times10^1$ Ω·cm to $1\times10^8$ Ω·cm, a primary particle diameter of the auxiliary charging particles is in a range from 0.01 μm to 10 μm, and a push-in amount of the brush with respect to the charging target is in a range from 0.1 mm to 2.0 mm.

Further, the invention provides an image forming apparatus including a photosensitive member, a contact charger having a brush in contact with the photosensitive member, and auxiliary charging particles interposed between the brush and the photosensitive member.

Fibers of the brush have a volume resistivity from $1\times10^1$ Ω·cm to $1\times10^8$ Ω·cm, a primary particle diameter of the auxiliary charging particles is in a range from 0.01 μm to 10 μm, and a push-in amount of the brush with respect to the photosensitive member is in a range from 0.1 mm to 2.0 mm.

The foregoing and other objects, features, aspects and advantages of the present invention will become more apparent from the following detailed description and the accompanying drawings.

DESCRIPTION OF THE PREFERRED EMBODIMENTS

Figure 1:
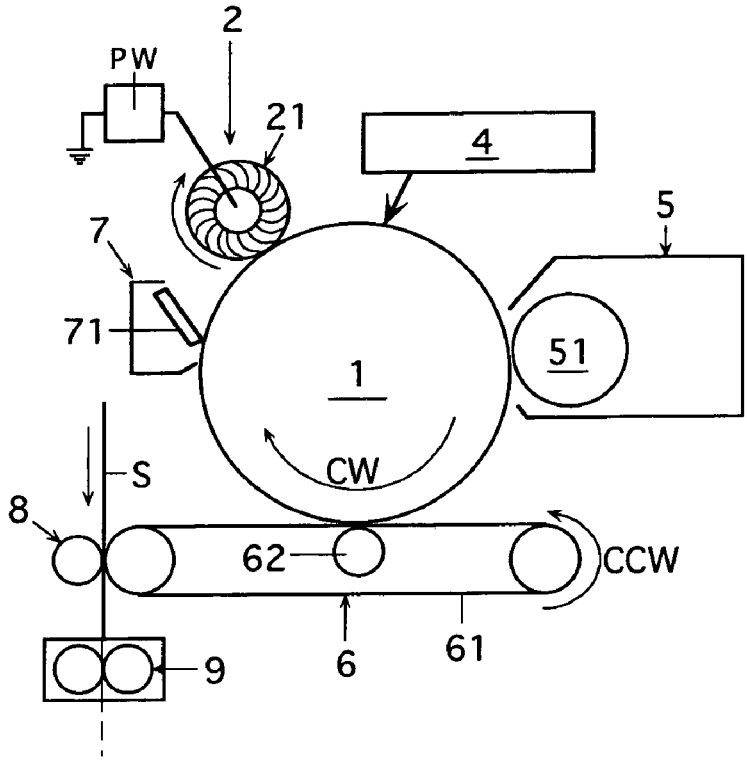
FIG. 1 schematically shows a structure of an example of an image forming apparatus according to the invention.

According to an embodiment of the invention, a contact charger for charging a charging target includes a brush to be in contact with the charging target, and auxiliary charging particles to be interposed between the brush and the charging target. Fibers of the brush have a volume resistivity from $1\times10^1$ Ω·cm to $1\times10^8$ Ω·cm, a primary particle diameter of the auxiliary charging particles is in a range from 0.01 μm to 10 μm, and a push-in amount of the brush with respect to the charging target is in a range from 0.1 mm to 2.0 mm.

The charging of the charging target may be performed by moving the brush relatively to the charging target.

Further, an electrophotographic image forming apparatus according to an embodiment of the invention includes the above contact charger as well as a photosensitive member, which is a charging target to be charged by the contact charger, an exposing device effecting image exposure on the photosensitive member to form an electrostatic latent image, and a developing device developing the electrostatic latent image on the photosensitive member.

Since the brush of the contact charger is in line-contact and/or point-contact with the charging target, a frictional force between the brush and the charging target is small, and it is possible to suppress sufficiently an amount of wearing of the brush and the charging target, which may be caused by the charging operation, so that durability of the contact charger and the charging target can be increased.

Since the contact charger does not utilize a discharging phenomenon, it is possible to prevent irregular charging due to excessive discharging. Further, the charging can be performed with a low voltage and at a low cost without generating ozone.

Although the brush is in line-contact and/or point-contact with the charging target, the auxiliary charging particles are present between the charging target and the brush so that a sufficiently large contact area can be ensured between the brush and the charging target, and more accurately, it is possible to achieve an effect equivalent to sufficient increase in contact area between the brush and the charging target. Thereby, intended injection charging can be performed.

Since the fibers of the brush have a volume resistivity from $1\times10^1$ Ω·cm to $1\times10^8$ Ω·cm, sufficient charges can be injected from the brush into the charging target. Also, since the primary particle diameter of the auxiliary charging particles is in a range from 0.01 μm to 10 μm, the particles can be stably adhered to the brush. The push-in amount of the brush with respect to the charging target is in a range from 0.1 mm to 2.0 mm. Thereby, the contact area for the injection charging can be ensured while keeping a sufficiently low contact resistance (electric resistance) between the brush and the charging target owing to an appropriate pressing force between the brush and the charging target. Thereby, the contact charger can stably and uniformly charge the charging target for a long term.

Further, the image forming apparatus using the above contact charger can uniformly and stably charge the surface of the photosensitive member for a long term, and therefore, can form good images with no or less image noises for a long term.

Specific examples of the contact charger and the image forming apparatus will now be described with reference to the drawings. FIG. 1 schematically shows a structure of an electrophotographic image forming apparatus provided with a contact charger 2.

<Image Forming Apparatus>

An image forming apparatus shown in FIG. 1 includes a photosensitive member 1 of a drum type, and also includes the contact charger 2, an image exposing device 4, a developing device 5, an intermediate transfer device 6 and a cleaning device 7, which are arranged in this order around the photosensitive member 1. A secondary transfer roller 8 is opposed to the intermediate transfer device 6. The image forming apparatus further includes a fixing roller pair 9. The developing device 5 is provided with a developing roller 51 and others.

The intermediate transfer device 6 is provided with an endless transfer belt 61 opposed to the photosensitive member 1 and a transfer roller 62 opposed to the photosensitive member 1 with the belt 61 therebetween. The cleaning device 7 includes a cleaning blade 71, which is in contact with the photosensitive member 1, and others.

According to this image forming apparatus, a drive unit (not shown) drives the photosensitive member 1 in a direction CW shown in FIG. 1, and the contact charger 2 uniformly charges the surface of the photosensitive member 1. The exposing device 4 effects image exposure corresponding to original images or image data on a charged region of the surface of the member 1 so that an electrostatic latent image is formed on the photosensitive member 1.

The developing roller 51 of the developing device 5 supplied with a developing bias develops this electrostatic latent image so that a visible toner image is formed. In the intermediate transfer device 6, the intermediate transfer belt 61 is driven by a drive unit (not shown) to rotate in a direction CCW shown in FIG. 1, and a transfer voltage is applied to the transfer roller 62.

The toner image on the photosensitive member 1, which reaches the transfer belt 61, is transferred onto the transfer belt 61 by the transfer roller 62 supplied with the transfer voltage. In synchronization with the toner image on the transfer belt 61, a recording medium S supplied from a recording medium supply portion (not shown) is supplied to a position between the transfer belt 61 and the secondary transfer roller 8, and the secondary transfer roller 8 supplied with the transfer voltage transfers the toner image from the transfer belt 61 onto the recording medium S. The recording medium S bearing the toner image thus transferred is sent to the fixing roller pair 9, which fixes the toner image by pressure and heat, and then is discharged onto a tray (not shown).

<Contact Charger>

The contact charger 2 basically has a brush 21 serving as a contact charging member to be in contact with the photosensitive member 1, i.e., the charging target, and auxiliary charging particles 3 are interposed between the brush 21 and the photosensitive member 1 for charging the photosensitive member 1. The brush 21 in this embodiment is of a fur-brush type, although not restricted to this. Fibers of the brush 21 have a volume resistivity from $1\times10^1$ Ω·cm to $1\times10^8$ Ω·cm, and a primary particle diameter of the auxiliary charging particles 3 is in a range from 0.01 μm to 10 μm. Also, a push-in amount of the brush 21 with respect to the photosensitive member 1 is in a range from 0.1 mm to 2.0 mm. By moving the brush 21 relatively to the photosensitive member 1, the photosensitive member 1 is charged.

Figure 2:
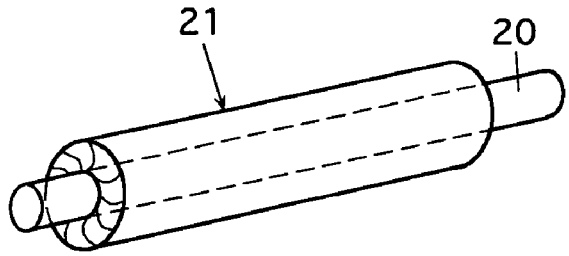
FIG. 2 is a perspective view of a contact charger shown in FIG. 1.
Figure 3:
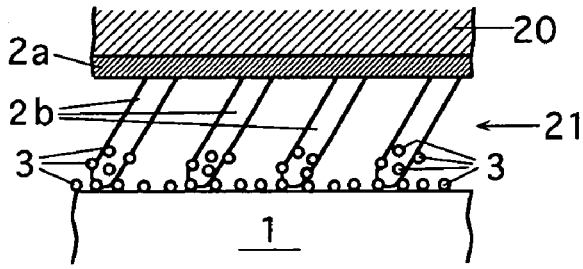
FIG. 3 schematically shows, on an enlarged scale, a portion of the contact charger shown in FIG. 2.

FIG. 2 is a schematic perspective view showing the contact charger 2, and FIG. 3 shows, on an enlarged scale, a portion of the charger 2.

The charger 2 includes the brush 21 of the roller type, in which brush piles formed of brush fibers 2*b* are set on base fabric 2*a*, and the base fabric 2*a* is adhered by double-faced adhesive tape to a surface of a cylindrical core roller 20. The base fabric has a rear surface, which is covered with electrically conductive coating or paint, and thus is electrically conductive. The double-faced adhesive tape is partially removed so that a part of the base fabric is in direct contact with the core roller 20 to achieve electrical conductivity between the brush 21 and the core roller 20. The brush 21 is supplied with a predetermined charging voltage from a power source PW via the core roller 20, and is driven to rotate by a drive unit (not shown).

The charger 2 may have a brush of a fixed type, in which brush piles formed of the brush fibers 2 b are set on the base fabric, and the base fabric is adhered to a metal sheet or the like by adhesive or the like.

The brush may be selected from two types, i.e., a straight hair type and an inclined hair type requiring a step of inclining the brush fibers in a manufacturing process. According to the inclined hair type, the fibers are inclined with respect to the charging target so that a large contact area can be easily ensured on the charging target, and therefore a region used for injecting the charges increases. Therefore, the charging can be performed further uniformly. In view of this, the inclined hair type is more advantageous. It is advantageous that the fur brush of the roller type rotates in such a direction that the rotating charging target smoothly strokes the brush because the rotation in the reverse direction disturbs and partially removes the fibers to cause a failure in charging.

In any case, the brush fibers 2*b* may be formed of general fibers, over which electrically conductive materials are distributed. Such fiber may be made of, e.g., polyamide (nylon), polyvinyl alcohol (vinylon), acrylic resin, polyester or viscose rayon.

The conductive materials may be metal such as aluminum, iron, copper or nickel, electrically conductive oxide such as zinc oxide, tin oxide or titanium oxide, or carbon particles made of, e.g., carbon black, graphite or carbon nanotube.

The brush fibers 2*b* may be made of electrically conductive polyamide (conductive nylon) UUN, GBN or SUN, electrically conductive vinylon USV or electrically conductive rayon REC, all of which are manufactured by Unitika Ltd.

If there is a failure such as a pin-hole in the photosensitive member 1, i.e., the charging target, an excessive current flows from the brush to such a faulty portion to cause faulty charging in the direction of the brush axis. Also, the brush fibers, through which the excessive current flows, may cause faulty charging in the brush rotating direction, and/or the excessive current may partially deteriorate the brush fibers and the faulty portion of the photosensitive member 1.

For preventing these problems, brush fibers having a volume resistivity not lower than $1\times10^{1}$ Ω·cm is employed regardless of the foregoing types and structures. For flowing a sufficient charging current required for the charging, it is preferable that the brush fibers have a volume resistivity not exceeding $1\times10^{8}$ Ω·cm. It is further preferable that the brush fibers have a volume resistivity from $1\times10^{2}$ Ω·cm to $1.2\times10^{5}$ Ω·cm.

The brush fibers 2*b* forming the brush preferably have a thickness from 1 denier to 10 deniers.

The filling density of the brush fibers 2*b* is preferably in a range from 155 pcs(pieces or fibers)/mm$^2$ to 10000 pcs/mm$^2$. If the filling density is excessive low, the brush cannot ensure a sufficient contact area on the photosensitive member 1, resulting in faulty charging. It is difficult or impossible to produce the brush having the filling density exceeding 10000 pcs/mm$^2$. It is further preferable that the brush has the fiber filling density from 217 pcs/mm$^2$ to 10000 pcs/mm$^2$.

<Auxiliary Charging Particle>

The auxiliary charging particles 3 may be made of metal oxide such as zinc oxide, tin oxide, titanium oxide, iron oxide, aluminum oxide or magnesium oxide, or carbon particles made of, e.g., carbon black, graphite, fullerene or carbon nanotube.

When using the metal oxide, it may contain metal element(s) other than the primary metal element(s). For example, zinc oxide containing aluminum, or tin oxide containing antimony can be used. Also, the particles 3 may be formed of a core material, which is made of titanium oxide, aluminum borate, barium sulfate or the like, and is coated with tin oxide containing antimony.

Among the above materials and structures, it is preferable that the auxiliary charging particles 3 are made of metal oxide such as zinc oxide, tin oxide or titanium oxide, zinc oxide containing aluminum, or tin oxide containing antimony, or have such materials on the surfaces. This is because the particles thus made have white or whitish appearance, which hardly impedes the image exposing. Also, the particles are hardly visible when transferred onto a paper sheet.

As the conductive zinc oxide, zinc oxide 23K manufactured by HakusuiTech Co., Ltd. is commercially available. Also, conductive tin oxide SN-100P manufactured by Ishihara Sangyo Co., Ltd. is commercially available. Further, ET-300W manufactured by Ishihara Sangyo Co., Ltd. and PASTORAN 4310 manufactured by Mitsui Mining & Smelting Co., Ltd. are available as the metal oxide coated with conductive tin oxide.

The primary particle diameter of the auxiliary charging particles 3 is preferably in a range from 0.01 μm to 10 μm. If the auxiliary charging particles 3 had an excessively small primary diameter, the auxiliary charging particles 3 would require a high manufacturing cost, and the charger would be expensive. If the auxiliary charging particles 3 of an excessive large particle diameter were used together with the brush of the roller type, rotation of the brush would produce a large centrifugal force, which acts on the auxiliary charging particles 3 to remove a large amount of particles from the brush, and it would be impossible to perform stably charging for a long term.

The primary particle diameter of the auxiliary charging particles 3 is more preferably in a range from 0.01 μm to 2 μm.

It is preferable that the auxiliary charging particles 3 have a volume resistivity not exceeding $1\times10^{10}$ Ω·cm. If it had a volume, resistivity exceeding $1\times10^{10}$ Ω·cm, it would be impossible to supply sufficient charges from the brush to the photosensitive member 1, resulting in irregular charging.

It is further preferable that the auxiliary charging particles 3 have a volume resistivity not exceeding $1\times10^{8}$ Ω·cm. If it had an excessively small volume resistivity, the particles adhered onto the surface of the photosensitive member would cause image flow. Therefore, it is preferable that the volume resistivity is not lower than $1\times10^{-4}$ Ω·cm.

<Adhesion Amount of Auxiliary Charging Particles>

The auxiliary charging particles 3 can be adhered onto the brush 21, e.g., by distributing an appropriate amount of auxiliary charging particles 3 over a flat plate, and rotating the brush 21 in contact with the plate to gather the auxiliary charging particles 3 on the brush 21. By changing an amount of the auxiliary charging particles 3 distributed over the flat plate, it is possible to control the amount of the particles 3 adhered onto the brush 21.

In any case, it is preferable that the auxiliary charging particles 3 exhibit an average adhesion amount from 0.3 mg/cm$^3$ to 20 mg/cm$^3$ in a space filled with the brush fibers of the brush. If the adhesion amount of the auxiliary charging particles 3 were excessively small, insufficient contact would occur between the brush and the photosensitive member 1 via the auxiliary charging particles 3, resulting in faulty charging. Also, the auxiliary charging particles 3 would be removed from the brush so that long-term stability would be impossible. Conversely, if the average adhesion amount were excessively large, the auxiliary charging particles 3 in the condensed or gathered form would move from the brush onto the photosensitive member 1, and would cause image noises. Further, the auxiliary charging particles 3 dispersed from the brush might smear surroundings.

It is more preferable that the auxiliary charging particles 3 exhibit an average adhesion amount from 0.6 mg/cm$^3$ to 15 mg/cm$^3$ in a space filled with the brush fibers of the brush.

In addition to portions of the brush fibers to be in contact with the photosensitive member 1, the auxiliary charging particles 3 may be adhered to base portions of the brush fibers so that the auxiliary charging particles 3 adhered onto the base portions can be supplied to the charging nip portion so as to compensate for removal or loss of the auxiliary charging particles 3.

When rotating the brush roller, a weak centrifugal force acts on the auxiliary charging particles 3 sticking to the base portions, and thereby gradually moves the auxiliary charging particles 3 toward the distal end of the brush so that the auxiliary charging particles 3 are supplied to the charging nip portion. Since this brush 21 have a function of charging the photosensitive member 1 as well as a function of supplying the auxiliary charging particles 3 by itself, the stable charging can be performed for a further long term by the simple structure.

As already described, a brush of an inclined hair type may be used instead of the straight hair type. The inclined hair type can easily ensure the contact area with respect to the charging target, and thus is advantageous from the viewpoint of uniform charging. In the inclined hair type, the auxiliary charging particles 3 on the base portions of the roller brush are covered with the outer inclined fibers of the brush so that excessive dispersion and movement of the particles to the charging nip portion are prevented, and the auxiliary charging particles 3 can be supplied to the charging nip portion more stably.

Auxiliary charging particle supply means other than the above may be employed. For example, the auxiliary charging particles 3 may be mixed into developer, and the developer thus prepared may be adhered onto the photosensitive member 1 for moving it to the charging nip portion. Alternatively, a supply member such as a roller, brush, blade or the like may be used for supplying the auxiliary charging particles 3. Addition of such supply means allows stable charging for a further long term.

<Charging>

The brush 21 carrying the auxiliary charging particles 3 is kept in contact with the photosensitive member 1 while keeping a predetermined push-in amount, and the photosensitive member 1 is charged by applying a DC bias from the power source PW to the brush 21 in a rotating state. Thereby, the photosensitive member 1 can be uniformly charged to attain the charged potential substantially equal to the applied voltage. For example, even after one thousand sheets are printed, the good charged state is obtained.

An alternating (AC) voltage may be superimposed on the DC bias. For example, a square wave of a peek-to-peek voltage of 500 V and a frequency of 1 kHz may be superimposed on the DC bias of −600 V.

<Rotation of Brush>

When the surface of the brush 21 moves counter to the moving direction of the surface of the photosensitive member 1, a relative speed ratio (relative peripheral speed ratio) $\theta$ of the brush 21 with respect to the photosensitive member 1 preferably satisfies a relationship of ($1 \leqq \theta < 5$). If $\theta$ were excessively small, the brush 21 could not achieve a sufficient contact amount with respect to the photosensitive member 1, resulting in faulty charging. If $\theta$ were excessively large, the brush 21 would slide on the photosensitive member 1 to a higher extent, and thereby might damage the surface of the photosensitive member 1 so that irregular charging would be liable to occur. Also, the photosensitive member 1 and the brush 21 would be shaved to a larger extent, which reduces the durability thereof. Further, a large centrifugal force would act on the auxiliary charging particles 3 on the brush 21. This would increase an amount of the particles removed from the brush 21 so that stable charging for a long term would be impossible.

It is further preferable in the above counter rotation operation that the relative speed ratio $\theta$ of the brush 21 with respect to the photosensitive member 1 satisfies a relationship of ($1.5 \leqq \theta < 4$).

The surface of the brush 21 may move together with the surface of the photosensitive member 1. Namely, the moving direction of the surface of the brush 21 may be the same as that of the surface of the member 1 at the charging nip portion. In this case, it is preferable that the relative speed ratio $\theta$ of the brush 21 with respect to the photosensitive member 1 satisfies a relationship of ($1.5 \leqq \theta < 5$). For achieving the speed ratio equal to that in the counter-rotation operation, the rotation speed must be increased. As the rotation speed increases, the brush 21 slides on the photosensitive member 1 to a higher extent so that the brush 21 is more liable to damage the surface of the photosensitive member 1, and therefore the irregular charging is liable to occur. Further, the photosensitive member 1 and the brush 21 are shaved to a higher extent, which reduces the durability thereof. Further, a large centrifugal force acts on the auxiliary charging particles 3 on the brush 21, and thereby increases the amount of particles removed from the brush 21 so that the stable charging for a long term becomes impossible. In view of the above, it is advantageous that the brush 21 rotates counter to the moving direction of the surface of the photosensitive member 1.

In the above with-rotation operation, it is further preferable that the speed ratio $\theta$ of the brush 21 with respect to the photosensitive member 1 satisfies a relationship of ($2 \leqq \theta < 4$)

<Push-In Amount of Brush>

It is preferable that the push-in amount of the brush 21 with respect to the photosensitive member 1 is a range from 0.1 mm to 2 mm. If the push-in amount were excessively small, it would be impossible to achieve a sufficiently stable contact amount (contact nip) between the brush 21 and the photosensitive member 1, and the pushing force would be small so that it would be impossible to reduce sufficiently a contact resistance (electric resistance) of the brush fibers and the auxiliary charging particles 3 with respect to the photosensitive member 1. This would result in irregular charging due to insufficient charging. If the push-in amount were excessively large, the brush 21 would apply an excessively large pushing force to the photosensitive member 1 so that a large frictional force would occur. Thereby, damages of the surface of the photosensitive member 1 as well as the irregular charging might occur, and the amount of wearing of the photosensitive member 1 and the brush 21 would increase so that the durability thereof would be short.

Further, the brush fibers would be deformed to a larger extent. This might cause the following situation. After the fibers passes through the charging nip portion, the brush fibers are spaced from the photosensitive member 1 and return to the initial form. In this returning operation, a large force acts on the auxiliary charging particles 3 on the brush fibers to remove them from the fibers so that a large amount of auxiliary charging particles 3 are removed from the brush fibers. Therefore, stable charging for a long term cannot be achieved.

The push-in amount of the brush 21 with respect to the photosensitive member 1 is preferably in a range from 0.24 mm to 1.0 mm, and is more preferably in a range from 0.3 mm to 0.8 mm.

EXPERIMENTAL EXAMPLES

Experimental examples, in which the contact chargers according to the embodiments of the invention were used for image formation, as well as comparative experimental examples will now be described. In the following experimental examples and comparative examples, printing was performed with a commercially available printer (magicolor 2200 DeskLaser manufactured by Minolta-QMS Co., Ltd.), in which a charger was replaced with one of the following contact chargers, and charts of a B/W 5% were printed.

Evaluation was effected on the contact chargers having the brush 21 of the structure shown in FIGS. 2 and 3. The brush fiber **2*b* was made of conductive nylon UUN (manufactured by Unitika Ltd.) formed of nylon 6 and carbon black dispersed therein. For forming the brush, the brush fibers 2***b* were set on base fabric, and the base fabric thus formed was wound around the core roller 20 of 6 mm in diameter, and was fixed thereto by double-face adhesive tape to provide a roller form, in which the base fabric and the double-face adhesive tape had a total thickness of 0.5 mm.

The roller thus produced was subjected to a hair-inclining step for inclining the brush fibers so that the hair-inclined brush roller was produced. The inclining direction of the fibers was determined such that the fibers of the brush 21 projects from the base fabric upstream (i.e., backwardly) in the rotation direction of the brush 21 when the surface of the brush 21 moves counter to the moving direction of the surface of the photosensitive member 1. The brush 21 had an outer diameter of 13.8 mm before inclining the fibers, and had an outer diameter of 12.2 mm after inclining the fibers. This fiber-inclination reduced the size of the brush fibers by 21% in the radial direction of the brush.

The photosensitive member of the foregoing printer had an outer diameter of 30 mm, and was rotated at 100 rpm (system speed of 160 mm/sec) in the experiments. The brush 21 carrying the auxiliary charging particles 3 was in contact with the photosensitive member, and the brush 21 was rotated to move counter to the moving direction of the surface of the photosensitive member. The speed ratio of the brush 21 with respect to the photosensitive member was equal to 2. The brush 21 was supplied with a DC bias of −700 V for charging the photosensitive member.

Experimental Example 1

In this example, brush fibers 2*b* were made of conductive nylon UUN (manufactured by Unitika Ltd.), which has a volume resistivity of $5\times10^3$ Ω·cm and a thickness of 2 deniers, and fiber filling density was 527 pcs/mm$^2$. The auxiliary charging particles were made of conductive tin oxide, and had a primary particle diameter of 0.2 μm. The conductive tin oxide particles were adhered onto the brush 21, and the push-in amount with respect to the photosensitive member was set to 0.5 mm for charging the photosensitive member. The conductive tin oxide particles forming the auxiliary charging particles were arranged in the space filled with the brush fibers 2*b* of the brush 21 at an average adhesion amount of 1.4 mg/cm$^3$.

Experimental Example 2

The photosensitive member was charged under the same conditions as those of the experimental example 1 except for that brush fibers were made of conductive nylon UUN (manufactured by Unitika Ltd.), which has a volume resistivity of $1\times10^1$ Ω·cm.

Experimental Example 3

The photosensitive member was charged under the same conditions as those of the experimental example 1 except for that brush fibers were made of conductive nylon UUN (manufactured by Unitika Ltd.), which has a volume resistivity of $1\times10^2$ Ω·cm.

Experimental Example 4

The photosensitive member was charged under the same conditions as those of the experimental example 1 except for that brush fibers were made of conductive nylon UUN (manufactured by Unitika Ltd.), which has a volume resistivity of $1.2\times10^5$ Ω·cm.

Experimental Example 5

The photosensitive member was charged under the same conditions as those of the experimental example 1 except for that brush fibers were made of conductive nylon UUN (manufactured by Unitika Ltd.), which has a volume resistivity of $1\times10^8$ Ω·cm.

Experimental Example 6

The photosensitive member was charged under the same conditions as those of the experimental example 1 except for that the auxiliary charging particles were made of conductive tin oxide and had a primary particle diameter of 0.01 μm.

Experimental Example 7

The photosensitive member was charged under the same conditions as those of the experimental example 1 except for that the auxiliary charging particles were made of conductive tin oxide and had a primary particle diameter of 2 μm.

Experimental Example 8

The photosensitive member was charged under the same conditions as those of the experimental example 1 except for that the auxiliary charging particles were made of conductive tin oxide and had a primary particle diameter of 10 μm.

Experimental Example 9

The photosensitive member was charged under the same conditions as those of the experimental example 1 except for that the push-in amount of the brush 21 with respect to the photosensitive member was 0.1 mm.

Experimental Example 10

The photosensitive member was charged under the same conditions as those of the experimental example 1 except for that the push-in amount of the brush 21 with respect to the photosensitive member was 0.24 mm.

Experimental Example 11

The photosensitive member was charged under the same conditions as those of the experimental example 1 except for that the push-in amount of the brush 21 with respect to the photosensitive member was 0.3 mm.

Experimental Example 12

The photosensitive member was charged under the same conditions as those of the experimental example 1 except for that the push-in amount of the brush 21 with respect to the photosensitive member was 0.8 mm.

Experimental Example 13

The photosensitive member was charged under the same conditions as those of the experimental example 1 except for that the push-in amount of the brush 21 with respect to the photosensitive member was 1 mm.

Experimental Example 14

The photosensitive member was charged under the same conditions as those of the experimental example 1 except for that the push-in amount of the brush 21 with respect to the photosensitive member was 2 mm.

Comparative Experimental Example 1

The photosensitive member was charged under the same conditions as those of the experimental example 1 except for that brush fibers were made of conductive nylon UUN (manufactured by Unitika Ltd.), which has a volume resistivity of $1\times10^{0}$ Ω·cm.

Comparative Experimental Example 2

The photosensitive member was charged under the same conditions as those of the experimental example 1 except for that brush fibers were made of conductive nylon UUN (manufactured by Unitika Ltd.), which has a volume resistivity of $1\times10^{9}$ Ω·cm.

Comparative Experimental Example 3

The photosensitive member was charged under the same conditions as those of the experimental example 1 except for that the auxiliary charging particles were made of conductive tin oxide and had a primary particle diameter of 15 μm.

Comparative Experimental Example 4

The photosensitive member was charged under the same conditions as those of the experimental example 1 except for that the push-in amount of the brush 21 with respect to the photosensitive member was 0.05 mm.

Comparative Experimental Example 5

The photosensitive member was charged under the same conditions as those of the experimental example 1 except for that the push-in amount of the brush 21 with respect to the photosensitive member was 2.2 mm.

In the experimental examples and comparative examples described above, the surface potential of the photosensitive member was measured in such conditions that a DC bias of −700 V was applied to the brush 21, and the charging property and charging irregularities were evaluated. The measurement was performed in the initial state and after printing one thousand sheets. The charging property was evaluated based on a difference |ΔV| between the voltage applied to the brush 21 and the surface potential of the photosensitive member. The charging irregularities were measured based on irregularities ΔV in charged potential. The evaluation was also effected on brush damages and faulty charging, which occurred when the photosensitive member had a pin-hole. Results were illustrated in a table 1.

The surface potential was measured with a surface potentiometer MODEL 344, probe 6000B-16 manufactured by Trek Japan corp.

In the table 1, the evaluation was performed based on the following criterion.

TABLE 1

| | | | | EVALUATION | | | | | |
|---|---|---|---|---|---|---|---|---|---|
| | Push-in Amount [mm] | Primary Particle Diameter [μm] | Volume Resistivity of Brush Fiber [Ω · cm] | Initial Charging Property | Initial Charging Irregularities | Charging Property after 1000-sheet printing | Charging Irregularities after 1000-sheet printing | Pin-hole Leakage | TOTAL |
| EX 1 | 0.5 | 0.2 | $5\times10^{3}$ | ◎ | ◎ | ◎ | ◎ | ◎ | ◎ |
| EX 2 | 0.5 | 0.2 | $1\times10^{1}$ | ◎ | ◎ | ◎ | ◎ | Δ | Δ |
| EX 3 | 0.5 | 0.2 | $1\times10^{2}$ | ◎ | ◎ | ◎ | ◎ | ○ | ○ |
| EX 4 | 0.5 | 0.2 | $1.2\times10^{5}$ | ○ | ○ | ○ | ○ | ◎ | ○ |
| EX 5 | 0.5 | 0.2 | $1\times10^{8}$ | Δ | Δ | Δ | Δ | ◎ | Δ |
| EX 6 | 0.5 | 0.01 | $5\times10^{3}$ | ◎ | ◎ | ◎ | ◎ | ◎ | ◎ |
| EX 7 | 0.5 | 2.0 | $5\times10^{3}$ | ◎ | ◎ | ○ | ○ | ◎ | ○ |
| EX 8 | 0.5 | 10.0 | $5\times10^{3}$ | ○ | ○ | Δ | Δ | ◎ | Δ |
| EX 9 | 0.1 | 0.2 | $5\times10^{3}$ | Δ | Δ | Δ | Δ | ◎ | Δ |
| EX 10 | 0.24 | 0.2 | $5\times10^{3}$ | ○ | ○ | ○ | ○ | ◎ | ○ |
| EX 11 | 0.3 | 0.2 | $5\times10^{3}$ | ◎ | ◎ | ◎ | ◎ | ◎ | ◎ |
| EX 12 | 0.8 | 0.2 | $5\times10^{3}$ | ◎ | ◎ | ◎ | ◎ | ◎ | ◎ |
| EX 13 | 1.0 | 0.2 | $5\times10^{3}$ | ◎ | ◎ | ○ | ○ | ◎ | ○ |
| EX 14 | 2.0 | 0.2 | $5\times10^{3}$ | ◎ | ◎ | Δ | Δ | ◎ | Δ |
| CX1 | 0.5 | 0.2 | $1\times10^{0}$ | ◎ | ◎ | ◎ | ◎ | X | X |
| CX2 | 0.5 | 0.2 | $1\times10^{9}$ | X | Δ | X | Δ | ◎ | X |
| CX3 | 0.5 | 15.0 | $5\times10^{3}$ | X | X | X | X | ◎ | X |
| CX4 | 0.05 | 0.2 | $5\times10^{3}$ | X | X | X | X | ◎ | X |
| CX5 | 2.2 | 0.2 | $5\times10^{3}$ | ◎ | ◎ | X | X | ◎ | X |

EX: Experimental Example
CX: Comparative Experimental Example
(Evaluation Criterion of Charging Property)
Double Circle ◎: |ΔV| < 20 V
Single Circle ○: 20 V ≦ |ΔV| < 30 V
Triangle Δ: 30 V ≦ |ΔV| < 50 V
Cross X: 50V ≦ |ΔV|
Evaluation Criterion of Charging Irregularities)
Double Circle ◎: ΔV < 20 V
Single Circle ○: 20 V ≦ ΔV < 30 V
Triangle Δ: 30 V ≦ ΔV < 50 V
Cross X: 50V ≦ ΔV TABLE 1-continued

| | | | EVALUATION | | | | | |
|---|---|---|---|---|---|---|---|---|
| Push-in Amount [mm] | Primary Particle Diameter [μm] | Volume Resistivity of Brush Fiber [Ω · cm] | Initial Charging Property | Initial Charging Irregularities | Charging Property after 1000-sheet printing | Charging Irregularities after 1000-sheet printing | Pin-hole Leakage | TOTAL |

Evaluation Criterion of Pin-hole Leak)
Double Circle ◎: Neither brush damage nor faulty charging occured.
Single Circle ○: Brush was slightly damaged but no faulty charging occured.
Triangle Δ: Brush was damaged and faulty charging occurred.
Cross X: Damage of brush and faulty charging were remarkable.

As described above, the charger employs the brush having a predetermined volume resistivity and the auxiliary charging particles having a predetermined primary particle diameter, and the brush is pushed against the charging target with a predetermined push-in amount so that excessive discharging, which occurs in the charging operation utilizing the discharging, is prevented, and a sufficiently large contact area can be ensured between the brush and the charging target. Also, the brush can supply a sufficient amount of injection charges to the charging target, and the contact resistance between the brush and the charging target can be sufficiently low. Therefore, uniform injection charging can be performed.

Further, the amounts of wearing of the brush and the charging target can be low, and therefore the durability thereof can be increased. The auxiliary charging particles can be stably adhered onto the brush, and the auxiliary charging particles adhered onto the base portion of the brush can be supplied to the nip portion so as to compensate for removal of the auxiliary charging particles. Therefore, stable charging can be performed for a long term.

For the above reasons, it is possible to provide the inexpensive charger, which operates with a low voltage without generating ozone, as well as the novel and useful image forming apparatus using such charger.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A contact charger for charging a charging target comprising:

a brush to be in contact with said charging target; and auxiliary charging particles to be interposed between said brush and said charging target, wherein fibers of said brush have a volume resistivity from $1\times10^1$ Ω·cm to $1\times10^8$ Ω·cm, a primary particle diameter of said auxiliary charging particles is in a range from 0.01 μm to 10 μm, a push-in amount of said brush with respect to the charging target is in a range from 0.1 mm to 2.0 mm, and the auxiliary charging particles exhibit an average adhesion amount from 0.3 mg/cm$^3$ to 20 mg/cm$^3$ in a space filled with said brush fibers.

2. The contact charger according to claim 1, wherein said brush moves relatively to said charging target for charging said charging target.

3. The contact charger according to claim 1, wherein said brush fibers have a volume resistivity from $1\times10^2$ Ω·cm to $1.2\times10^5$ Ω·cm.

4. The contact charger according to claim 1, wherein the primary particle diameter of said auxiliary charging particles is in a range from 0.01 μm to 2 μm.

5. The contact charger according to claim 1, wherein the push-in amount of said brush with respect to the charging target is in a range from 0.24 mm to 1.0 mm.

6. The contact charger according to claim 1, wherein the push-in amount of said brush with respect to the charging target is in a range from 0.3 mm to 0.8 mm.

7. The contact charger according to claim 1, wherein said auxiliary charging particles are adhered onto said brush fibers.

8. The contact charger according to claim 1, wherein said brush fibers have a thickness from 1 denier to 10 deniers.

9. A contact charger for charging a charging target comprising:

a brush to be in contact with said charging target; and auxiliary charging particles to be interposed between said brush and said charging target, wherein fibers of said brush have a volume resistivity from $1\times10^1$ Ω·cm to $1\times10^8$ Ω·cm, a primary particle diameter of said auxiliary charging particles is in a range from 0.01 μm to 10 μm a push-in amount of said brush with respect to the charging target is in a range from 0.1 mm to 2.0 mm, and said auxiliary charging particles exhibit an average adhesion amount from 0.6 mg/cm$^3$ to 15 mg/cm$^3$ in a space filled with said brush fibers.

10. An image forming apparatus comprising:

a photosensitive member;

a contact charger having a brush in contact with said photosensitive member; and auxiliary charging particles interposed between said brush and the photosensitive member, wherein fibers of said brush have a volume resistivity from $1\times10^1$ Ω·cm to $1\times10^8$ Ω·cm, a primary particle diameter of said auxiliary charging particles is in a range from 0.01 μm to 10 μm, a push-in amount of said brush with respect to the photosensitive member is in a range from 0.1 mm to 2.0 mm said auxiliary charging particles exhibit an average adhesion amount from 0.3 mg/cm$^3$ to 20 mg/cm$^3$ in a space filled with said brush fibers.

11. The image forming apparatus according to claim 10, wherein said brush moves relatively to said photosensitive member for charging said photosensitive member.

12. The image forming apparatus according to claim 10, wherein said brush fibers have a volume resistivity from $1\times10^2$ Ω·cm to $1.2\times10^5$ Ω·cm.

13. The image forming apparatus according to claim 10, wherein the primary particle diameter of said auxiliary charging particles is in a range from 0.01 $\mu$m to 2 $\mu$m.

14. The image forming apparatus according to claim 10, wherein the push-in amount of said brush with respect to the photosensitive member is in a range from 0.24 mm to 1.0 mm.

15. The image forming apparatus according to claim 10, wherein the push-in amount of said brush with respect to the photosensitive member is in a range from 0.3 mm to 0.8 mm.

16. The image forming apparatus according to claim 10, wherein said auxiliary charging particles are adhered onto said brush fibers.

17. The image forming apparatus according to claim 10, wherein said brush fibers have a thickness from 1 denier to 10 deniers.

18. An image forming apparatus comprising:

a photosensitive member;

a contact charger having a brush in contact with said photosensitive member; and auxiliary chaining particles interposed between said brush and the photosensitive member, wherein fibers of said brush have a volume resistivity from $1\times10^{1}$ Ω·cm to $1\times10^{8}$ Ω·cm, a primary particle diameter of said auxiliary chaining particles is in a range from 0.01 $\mu$m to 10 $\mu$m, a push-in amount of said brush with respect to the photosensitive member is in a range from 0.1 mm to 2.0 mm, and said auxiliary charging particles exhibit an average adhesion amount from 0.6 mg/cm$^3$ to 15 mg/cm$^3$ in a space filled with said brush fibers.

* * * * *

UNITED STATES PATENT AND TRADEMARK OFFICE

CERTIFICATE OF CORRECTION

PATENT NO. : 6,999,699 B2
APPLICATION NO. : 10/745858
DATED : February 14, 2006
INVENTOR(S) : Yuji Nagatomo It is certified that error appears in the above-identified patent and that said Letters Patent is hereby corrected as shown below:

Column 16,
Line 56, insert -- , and -- after "mm"; and

Column 18,
Line 9, change "chaining" to -- charging --.

Signed and Sealed this

Twenty-seventh Day of June, 2006

JON W. DUDAS
*Director of the United States Patent and Trademark Office*